US012624414B2

(12) United States Patent
Hirai et al.

(10) Patent No.: US 12,624,414 B2
(45) Date of Patent: May 12, 2026

(54) COOLING WATER TEMPERATURE CONTROL METHOD AND COOLING WATER TEMPERATURE CONTROL DEVICE FOR STEEL SHEET

(71) Applicant: JFE STEEL CORPORATION, Tokyo (JP)

(72) Inventors: Masaki Hirai, Tokyo (JP); Yusuke Ota, Tokyo (JP); Ichiro Tanokuchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 531 days.

(21) Appl. No.: 18/275,243

(22) PCT Filed: Dec. 27, 2021

(86) PCT No.: PCT/JP2021/048585
§ 371 (c)(1),
(2) Date: Aug. 1, 2023

(87) PCT Pub. No.: WO2022/215304
PCT Pub. Date: Oct. 13, 2022

(65) Prior Publication Data

US 2024/0102125 A1 Mar. 28, 2024

(30) Foreign Application Priority Data

Apr. 5, 2021 (JP) ..... 2021-064438

(51) Int. Cl.
*C21D 11/00* (2006.01)
*C21D 9/573* (2006.01)

(52) U.S. Cl.
CPC ..... *C21D 11/005* (2013.01); *C21D 9/573* (2013.01)

(58) Field of Classification Search
CPC ..... C21D 11/005; C21D 9/573; C21D 1/63; C21D 1/60; C21D 9/5737
See application file for complete search history.

(56) References Cited

U.S. PATENT DOCUMENTS

2011/0162424 A1* 7/2011 Seidel ..... B21B 45/0281 72/38

FOREIGN PATENT DOCUMENTS

JP S53-146209 A 12/1978
JP S56-72128 A 6/1981
(Continued)

OTHER PUBLICATIONS

Akimoto Hiroyuki et.al. [JP2015189998A] (machine translation) (Year: 2015).*

(Continued)

*Primary Examiner* — Sally A Merkling
*Assistant Examiner* — Nazmun Nahar Shams
(74) *Attorney, Agent, or Firm* — OLIFF PLC.

(57) ABSTRACT

A cooling water temperature control method, includes: calculating thickness of a water film remaining on a steel sheet; calculating a change in the thickness of the water film; calculating a change in temperature of the steel sheet; calculating a steel sheet temperature on an exit side of a draining roll at which a position where the thickness of the water film on the steel sheet becomes zero coincides with an exit side position of a drying equipment, and setting the calculated temperature to a lower limit value; calculating a steel sheet temperature on the exit side of the draining roll at which the steel sheet temperature on the entrance side of coating equipment coincides with a predetermined temperature and setting the calculated temperature to an upper limit (Continued)

value; and controlling the temperature of cooling water within a range of the lower limit value and the upper limit value.

2 Claims, 3 Drawing Sheets

(56) References Cited

FOREIGN PATENT DOCUMENTS

| | | | | |
|---|---|---|---|---|
| JP | S61-136636 | A | | 6/1986 |
| JP | S62-21076 | U | | 2/1987 |
| JP | H08193276 | A | * | 7/1996 |
| JP | H09-42843 | A | | 2/1997 |
| JP | 2003-277834 | A | | 10/2003 |
| JP | 3617131 | B2 | | 2/2005 |
| JP | 2015-189998 | A | | 11/2015 |

OTHER PUBLICATIONS

Adachi Shigeyoshi et.al. [JPH08193276A] (machine translation) (Year: 1996).*
Naruse Yutaka [JPH0942843A] (machine translation) (Year: 1997).*
Jun. 14, 2024 Extended European Search Report issued in European Patent Application No. 21936101.1.
Mar. 8, 2022 International Search Report issued in International Patent Application No. PCT/JP2021/048585.

* cited by examiner

COOLING WATER TEMPERATURE CONTROL METHOD AND COOLING WATER TEMPERATURE CONTROL DEVICE FOR STEEL SHEET

FIELD

The present invention relates to a cooling water temperature control method and a cooling water temperature control device for a steel sheet.

BACKGROUND

In an annealing process line for a thin steel sheet, coating is performed on the surface of the annealed steel sheet using coating equipment. In general, from the viewpoint of characteristics of coating liquid used for coating and coating quality, it is necessary to set the temperature of the steel sheet to a predetermined temperature (for example, 30° C.) or lower on an entrance side of the coating equipment. Therefore, the temperature of the annealed steel sheet is controlled to a predetermined temperature or lower by immersing the steel sheet in cooling water having a predetermined temperature or lower or spraying the cooling water having the predetermined temperature or lower on the steel sheet using water cooling equipment (see Patent Literature 1). If the cooling water used in the water cooling equipment remains as a water film on the steel sheet, since a problem occurs in the coating quality, the water film is removed by providing drying equipment on an exit side of the water cooling equipment and blowing dehumidified air from the drying equipment (see Patent Literature 2).

Here, a method of cooling and drying the annealed steel sheet on the entrance side of the coating equipment is specifically explained with reference to FIG. 4. FIG. 4 is a schematic diagram for explaining a method of cooling and drying the annealed steel sheet on the entrance side of the coating equipment. As illustrated in FIG. 4, in this method, an annealed steel sheet S is cooled to a cooling water temperature by immersing the annealed steel sheet S in cooling water W in the f water cooling tank 1 and, thereafter, a water film on the steel sheet S is removed (drained) by a draining roll 2 on an exit side of the water cooling tank 1. However, the water film on the steel sheet S cannot be completely removed only by the draining roll 2. In general, a water film having thickness of 3 μm or less remains on the steel sheet S after the water film is removed by the draining roll 2. When the steel sheet S is coated in a state in which the water film remains, a problem in coating quality occurs. Therefore, dehumidified air is blown against the steel sheet S using drying equipment 4 after the draining, the water film remaining on the steel sheet S is completely removed, and, thereafter, the steel sheet S is coated by coating equipment 5.

Note that, in a cooling process for the steel sheet S, the temperature of the cooling water W rises with heat quantity taken from the steel sheet S having temperature of 100° C. or lower after annealing. Therefore, the cooling water W in the water cooling tank 1 is sent to a chiller 7 by a circulation pump 6 and the cooling water W is cooled to predetermined temperature using the chiller 7 and thereafter returned to the water cooling tank 1 to make it possible to continuously cool the steel sheet S. In a drying process for the steel sheet S, if the dehumidified air is at a high temperature, the steel sheet temperature exceeds a predetermined temperature, which causes a problem in coating quality. Therefore, in general, hot air (approximately 80 to 95° C.) subjected to heat exchange by steam is used as the dehumidified air. However, for the above reason, the steel sheet S is dried using the dehumidified air having low temperature from a dehumidifier 8.

Subsequently, a relation between a steel sheet temperature and a water film thickness is explained with reference to FIG. 5. FIG. 5 is a schematic diagram for explaining the relation between the steel sheet temperature and the water film thickness. In FIG. 5, the vertical axis indicates the steel sheet temperature and the water film thickness and the horizontal axis indicates the distance from the draining roll 2. AS illustrated in FIG. 5, first, in the position of the draining roll 2, the steel sheet temperature coincides with a cooling water temperature. Subsequently, in a path to an entrance side of the drying equipment 4, the steel sheet temperature is slightly lowered by heat extraction (heat of vaporization) due to evaporation (vaporization) of the water film generated from the difference between water vapor concentration in the atmosphere and water vapor concentration of the water film. Subsequently, in the drying equipment 4, the steel sheet temperature is changed by addition and subtraction (heat input during drying) of heat quantity received from the dehumidified air 9 and heat quantity removed when the water film is vaporized. In a bath to the coating equipment 5, a temperature change of the steel sheet S due to heat transfer caused by the temperature difference between the atmosphere and the steel sheet S is taken into account to set the steel sheet temperature on an entrance side of the coating equipment 5 be equal to or lower than a predetermined temperature necessary for coating quality.

On the other hand, as explained above, the thickness of the water film on an exit side of the draining roll 2 (water film thickness) is 3 μm or less. The water film thickness slightly reduced by evaporation (vaporization) of the water film in a path from the exit side of the draining roll 2 to the drying equipment 4. In the drying equipment 4, the water film thickness is further reduced by evaporation caused from the difference between water vapor concentration of the dehumidified air 9 and the water vapor concentration of the water film. An evaporation amount m ($kg/m^2 \cdot s$) of the water film at that time can be indicated by a mass transfer equation indicated by the following Formula (1). Here, $h_0$ indicates a mass transfer rate (m/s), ρ indicates the density of water ($kg/m^3$), $\omega_0$ indicates the water vapor concentration of the water film, and $\omega_\infty$ indicates the water vapor concentration of the dehumidified air 9. Finally, all the water film evaporates in the drying equipment 4 and the steel sheet S is completely dried.

$$m = h_0 \times \rho \times (\omega_0 - \omega_\infty) \quad (1)$$

CITATION LIST

Patent Literature

Patent Literature 1: JP 2003-277834 A
Patent Literature 2: JP 2015-189998 A

SUMMARY

Technical Problem

In a period with low temperature such as winter, the temperature of the steel sheet S cooled in the water cooling tank 1 is sometimes lower than a predetermined temperature (for example, 20° C. or lower). This is because (a) the steel sheet S is greatly cooled by heat transfer to the air in a path from an annealing furnace to the water cooling tank 1 and heat quantity taken by the cooling water W from the steel sheet S in the water cooling tank 1 decreases, (b) the cooling water temperature drops because heat radiation from the water cooling tank 1 is large, and (c) the temperature of the cooling water W drops when the makeup water 10 (see FIG. 4) is supplied to the water cooling tank 1 because the temperature of the makeup water 10 supplied to the water cooling tank 1 is low. Tt a start-up time after a line is stopped for a long period, since the temperature of the cooling water W drops to the temperature in a factory, the cooling water temperature is often lower than the predetermined temperature except in the summer.

In such a case, the steel sheet temperature after the cooling becomes lower than the predetermined temperature and the water film remaining on the steel sheet S cannot be completely dried by the drying equipment 4. This is because, as illustrated in FIG. 6, the water vapor concentration $\omega_0$ of the water film in the above Formula (1) decreases according to the temperature drop and the evaporation amount m of the water film decreases. Note that, in order to solve such a problem, it is conceivable to completely dry the water film by reducing line speed and increasing a drying time. However, when this method is used, production efficiency is deteriorated. It is also conceivable to increase the length of the drying equipment 4 and increase the drying time. However, when this method is used, expenses for adding expensive equipment such as a dehumidifier in order to increase a dehumidified air amount is necessary. Further, the method is not established if there is restriction on an installation space for increasing the length of the drying equipment 4. The method is not effective and realistic means.

From the above, the conventional method for cooling and drying a steel sheet has a problem in application to a case in which the steel sheet temperature is cooled to temperature lower than the predetermined temperature.

The present invention has been made in view of the above problems, and an object of the present invention is to provide a cooling water temperature control method and a cooling water temperature control device for a steel sheet capable of cooling an annealed steel sheet to a predetermined temperature or lower and completely drying the annealed steel sheet even in a cold period or when a line is started up again after being stopped for a long period.

Solution to Problem

To solve the problem and achieve the object, a cooling water temperature control method for a steel sheet according to the present invention is a method for controlling temperature of cooling water in a line including cooling equipment that cools an annealed steel sheet using the cooling water, a draining roll that removes a water film on the steel sheet cooled by the cooling equipment, drying equipment that is disposed on an exit side of the draining roll and dries the steel sheet, and coating equipment that is disposed on an exit side of the drying equipment and coats the steel sheet. The cooling water temperature control method includes: a first step of calculating thickness of the water film remaining on the steel sheet on the exit side of the draining roll; a second step of calculating a change in the thickness of the water film from the exit side of the draining roll to the exit side of the drying equipment considering line speed; a third step of calculating a change in temperature of the steel sheet from the exit side of the draining roll to an entrance side of the coating equipment considering the line speed; a fourth step of calculating, using calculation results of the first to third steps, a steel sheet temperature on the exit side of the draining roll at which a position where the thickness of the water film on the steel sheet becomes zero coincides with an exit side position of the drying equipment, and setting the calculated steel sheet temperature to a lower limit value of cooling water temperature; a fifth step of calculating, using the calculation results of the first to third steps, a steel sheet temperature on the exit side of the draining roll at which the steel sheet temperature on the entrance side of the coating equipment coincides with a predetermined temperature and setting the calculated steel sheet temperature to an upper limit value of the cooling water temperature; and a sixth step of controlling the temperature of the cooling water within a range of the lower limit value and the upper limit value set in the fourth and fifth steps.

Moreover, a cooling water temperature control device for a steel sheet according to the present invention is a device that controls temperature of cooling water in a line including cooling equipment that cools an annealed steel sheet using the cooling water, a draining roll that removes a water film on the steel sheet cooled by the cooling equipment, drying equipment that is disposed on an exit side of the draining roll and dries the steel sheet, and coating equipment that is disposed on an exit side of the drying equipment and coats the steel sheet. The cooling water temperature control device includes: first means for calculating thickness of the water film remaining on the steel sheet on the exit side of the draining roll; second means for calculating a change in the thickness of the water film from the exit side of the draining roll to the exit side of the drying equipment considering line speed; third means for calculating a change in temperature of the steel sheet from the exit side of the draining roll to an entrance side of the coating equipment considering the line speed; fourth means for calculating, using calculation results of the first to third means, a steel sheet temperature on the exit side of the draining roll at which a position where the thickness of the water film on the steel sheet becomes zero coincides with an exit side position of the drying equipment, and setting the calculated steel sheet temperature to a lower limit value of cooling water temperature; fifth means for calculating, using the calculation results of the first to third means, a steel sheet temperature on the exit side of the draining roll at which the steel sheet temperature on the entrance side of the coating equipment coincides with a predetermined temperature and setting the calculated steel sheet temperature to an upper limit value of the cooling water temperature; and sixth means for controlling the temperature of the cooling water within a range of the lower limit value and the upper limit value set in the fourth and fifth means.

Advantageous Effects of Invention

According to the cooling water temperature control method and the cooling water temperature control device for the steel sheet according to the present invention, it is possible to cool the annealed steel sheet to the predetermined temperature or lower and completely dry the annealed steel sheet even in a cold period or when the line is started up again after being stopped for a long period.

DESCRIPTION OF EMBODIMENTS

In the following explanation, a cooling water temperature control method and a cooling water temperature control device for a steel sheet according to an embodiment of the present invention is explained.

Figure 1:
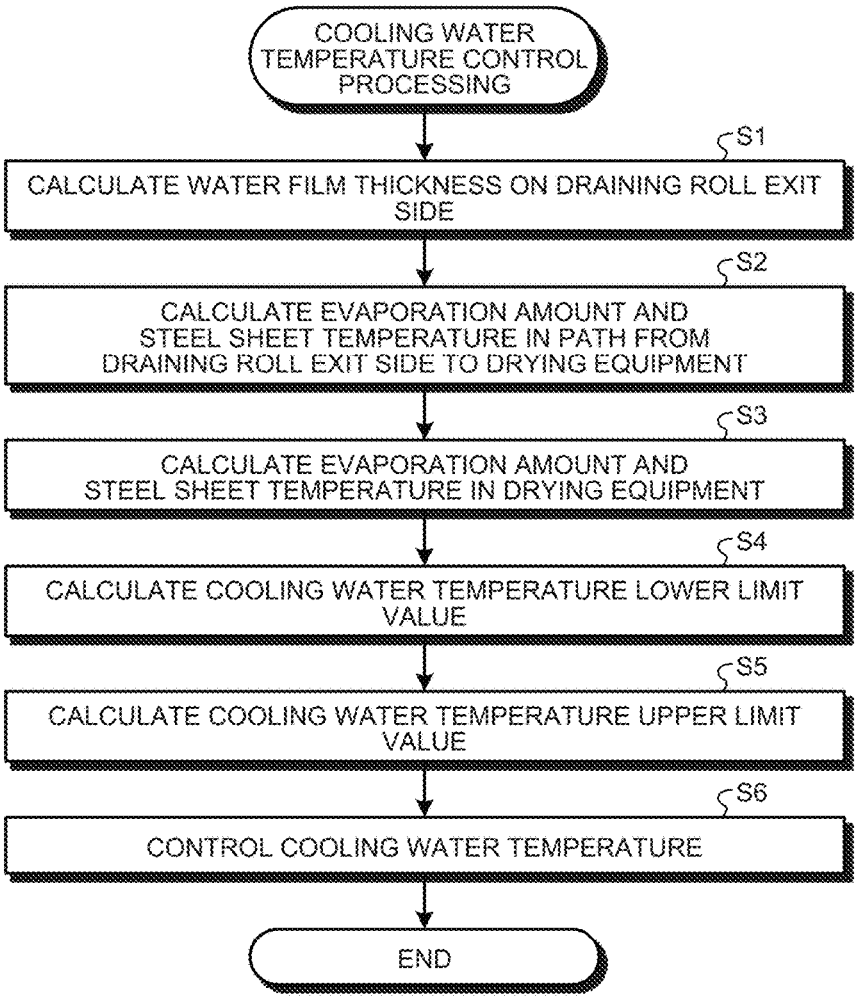
FIG. 1 is a flowchart illustrating a flow of cooling water temperature control processing of a steel sheet according to an embodiment of the present invention.

FIG. 1 is a flowchart illustrating a flow of cooling water temperature control processing for a steel sheet according to an embodiment of the present invention. As illustrated in FIG. 1, in the cooling water temperature control processing for the steel sheet according to the embodiment of the present invention, first, thickness of a water film remaining on a steel sheet S on an exit side of a draining roll 2 is calculated (step S1). Specifically, thickness h (μm) of a water film remaining on the steel sheet S after draining by the draining roll 2 is proportional to the 0.6 power of line speed and can be calculated by the following Formula (2). Here, μ indicates viscosity (kgf·s/m) of water, p indicates a draining roll linear pressure (kgf/m), v indicates line speed (m/s), E indicates an equivalent Young's modulus (kgf/m$^2$) of draining roll surface rubber and a steel sheet, and R indicates a draining roll radius (m).

$$h=3.1\times\mu^{0.6}\times p^{-0.2}\times v^{0.6}\times E^{-0.4}\times R^{0.6}\times 10^{6} \quad (2)$$

Subsequently, an evaporation amount of the water film into the atmosphere in a path from the exit side of the draining roll 2 to drying equipment 4 and a steel sheet temperature that changes according to heat of vaporization and heat transfer to the atmosphere at the time when the water film evaporates are calculated (step S2). Specifically, the evaporation amount of the water film into the atmosphere is inversely proportional to the line speed and an evaporation amount m (kg/(m$^2$·s)) of the water film per unit time can be calculated by the following Formula (3). Here, $h_0$ indicates a mass transfer rate (m/s), ρ indicates the density of water (kg/m$^3$), $\omega_0$ indicates water vapor concentration of the water film, and $\omega_\infty$ indicates water vapor concentration of the atmosphere.

$$m=h_0\times\rho\times(\omega_0-\omega_\infty) \quad (3)$$

On the other hand, the steel sheet temperature that chances according to heat of vaporization and heat transfer to the atmosphere at the time when the water film evaporates is inversely proportional to the line speed and a heat quantity Q (kcal/(m$^2$·s)) obtained by the steel sheet per unit time can be calculated by the following Formula (4). Here, α indicates a heat transfer coefficient (kcal/(m$^2$·s·° C.)), $T_0$ indicates a steel sheet temperature (° C.), $T_\infty$ indicates an atmospheric temperature (° C.), m indicates an evaporation amount (kg/(m$^2$·s)) of the water film, L indicates evaporation latent heat (kcal/m$^2$), and d indicates a sheet thickness (m) of the steel sheet. When a very short time in a path from the exit side of the draining roll 2 to the drying equipment 4 is represented as Δt, the steel sheet temperature can be calculated by repeatedly performing calculation as follows based on the evaporation amount m and the heat quantity Q of the water film. That is, when the steel sheet temperature at time $t=t_{n-1}$ is represented as $T_{0n-1}$, the evaporation latent heat (kcal/m$^2$) at time $t=t_{n-1}$ is represented as $L_{n-1}$, the heat transfer coefficient (kcal/(m$^2$·s·° C.)) at time $t=t_{n-1}$ is represented as $\alpha_{n-1}$, the atmospheric temperature (° C.) at time $t=t_{n-1}$ is represented as $T_{\infty n-1}$, the density of the steel sheet (kg/m$^3$) is represented as $\rho_s$, the sheet thickness (m) of the steel sheet is represented as d, and the specific heat (kcal/(kg·° C.)) of the steel sheet is represented as c, a steel sheet temperature $T_{0n}$ at time $t=t_n$ is represented by the following Formula (5). Therefore, by repeatedly calculating the steel sheet temperature $T_{0n}$ using this formula (5), the steel sheet temperature at each position of the path can be obtained.

$$Q=\alpha(T_0-T_\infty)-m\cdot(L/(\rho\cdot d)) \quad (4)$$

$$T_{0n}=T_{0n-1}-(L_{n-1}/\Delta t+2\times\alpha_{n-1}/3600\times(T_{0n-1}-T_{\infty n-1}))/(\rho_s\times d\times c)\times\Delta t) \quad (5)$$

Subsequently, an evaporation amount of the water film by dehumidified air 9 blown against the steel sheet S by the drying equipment 4 and a steel sheet temperature that changes according to heat of vaporization at the time when the water film evaporates and heat transfer to the dehumidified air 9 are calculated (step S3). Specifically, the evaporation amount of the water film into the dehumidified air 9 can be calculated by Formula (3) explained above. On the other hand, the steel sheet temperature that changes according to the heat of vaporization at the time when the water film evaporates and the heat transfer to the dehumidified air is inversely proportional to the line speed. The heat quantity Q (kcal/m$^2$·s) that the steel sheet obtains per unit time can be calculated by Formula (4) explained above. However, in this case, the temperature (° C.) of the dehumidified air is used as $T_\infty$ in Formula (4). The steel sheet temperature can be determined in the same manner as described above.

Subsequently, using processing results in step S1 to step S3, the steel sheet temperature on the exit side of the draining roll 2 is calculated such that a position of complete drying where the thickness of the water film becomes zero coincides with an exit side position of the drying equipment 4. Here, the thickness of the water film at the exit side position of the drying equipment can be calculated by repeatedly performing calculation as follows based on the thickness h of the water film remaining on the steel sheet S after draining and the evaporation amount m of the water film. That is, when the thickness of the water film at the time $t=t_{n-1}$ is represented as $h_{n-1}$ and the evaporation amount of the water film is represented as $m_{n-1}$, the thickness $h_n$ of the water film at the time $t=t_n$ is represented by the following Formula (6). Therefore, by repeatedly calculating the thickness $h_n$ of the water film using this Formula (6), thicknesses of the water film in respective positions of the path can be calculated. On the other hand, the evaporation amount of the water film into the dehumidified air 9 can be calculated by Formula (3) explained above. Therefore, the steel sheet temperature on the draining roll exit side only has to be determined such that the thickness of the water film becomes zero. Since the steel sheet temperature and the cooling water temperature match on the exit side of the draining roll 2, the calculated steel sheet temperature is set to a lower limit value Tmin of the cooling water temperature necessary for completely drying the steel sheet S (step S4). When the cooling water temperature is higher than the lower limit value Tmin, the water film remaining on the steel sheet S on the exit side of the draining roll 2 can be completely dried in the drying equipment 4.

$$h_n = h_{n-1} - (\Delta t \times m_n \times 1000) \quad (6)$$

Next, in the path from the exit side of the drying equipment 4 to the entrance side of the coating equipment 5, a steel sheet temperature that changes according to heat transfer to the atmosphere is calculated. Specifically, the steel sheet temperature that changes according to the heat transfer to the atmosphere is inversely proportional to the line speed. The heat quantity Q (kcal/m$^2$·s) that the steel sheet obtains per unit time can be calculated by the following Formula (7). Here, α indicates a heat transfer coefficient (kcal/m$^2$·s·° C.), $T_0$ indicates a steel sheet temperature (° C.), and $T_\infty$ represents an atmospheric temperature (° C.). When an amount of a rise in the steel sheet temperature in a very short time is represented as ΔT, since ΔT=Q/(mass of the steel sheet× specific heat of the steel sheet), the steel sheet temperature $T_n$ can be calculated by repeated performing calculation as follows. That is, when the steel sheet temperature at the time $t=t_{n-1}$ is represented as $T_{n-1}$, the steel sheet temperature $T_n$ at time $t=t_n$ is represented by the following Formula (8). Therefore, by repeatedly calculating the steel sheet temperature $T_n$ using this Formula (8), steel sheet temperatures in respective positions of the path can be obtained.

$$Q = \alpha(T_0 - T_\infty) \quad (7)$$

$$T_n = T_{n-1} + \Delta T \quad (8)$$

From Formula (7) described above, a steel sheet temperature on the exit side of the drying equipment 4 is calculated such that the steel sheet temperature on the entrance side of the coating equipment 5 coincides with a predetermined temperature (for example, 30° C.) and a steel sheet temperature on the exit side of the draining roll 2 is calculated such that the steel sheet temperature coincides with the calculated steel sheet temperature. As explained above, since the steel sheet temperature and the cooling water temperature coincide on the exit side of the draining roll 2, the calculated steel sheet temperature is set to an upper limit value Tmax of the cooling water temperature necessary for completely drying the steel sheet S (step S5). Consequently, a temperature range (the lower limit value Tmin to the upper limit value Tmax) of the cooling water in which the annealed steel sheet S can be cooled to the predetermined temperature or lower and completely dried can be calculated.

From the above, when cooling the annealed steel sheet S, by measuring the temperature of the cooling water W in a water cooling tank 1 and controlling the temperature to be in the temperature range of the cooling water W calculated by the processing explained above, it is possible to cool the annealed steel sheet to the predetermined temperature or lower and completely dry the annealed steel sheet (step S6). Note that, at this time, since energy efficiency is better when a temperature adjustment margin is smaller, the temperature of the cooling water W is controlled to the lower limit value Tmin, for example, when the measured value of the temperature of the cooling water W is smaller than the lower limit value Tmin.

Figure 2:
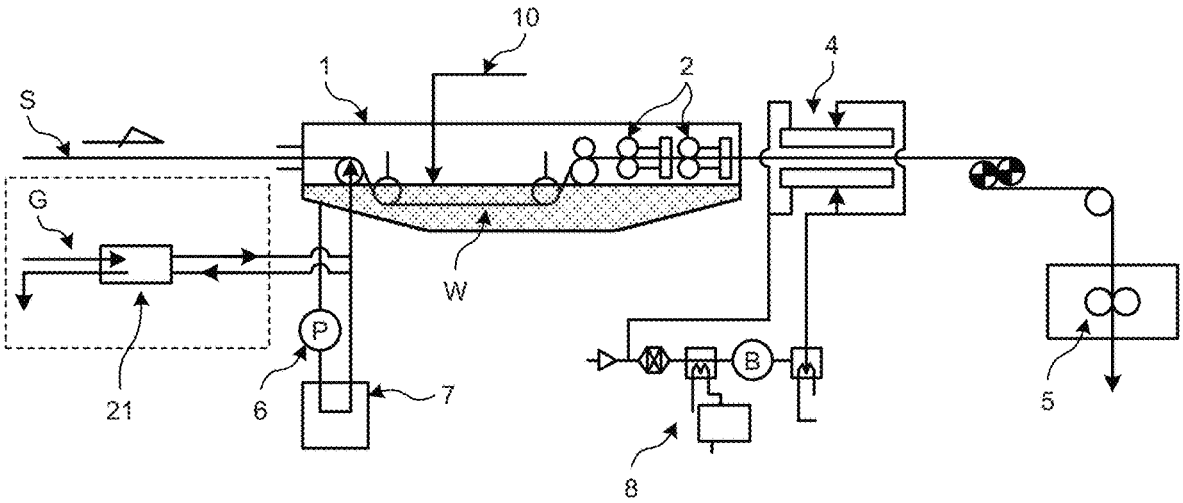
FIG. 2 is a schematic diagram illustrating a configuration of a cooling water temperature control device for a steel sheet according to an embodiment of the present invention.
Figure 4:
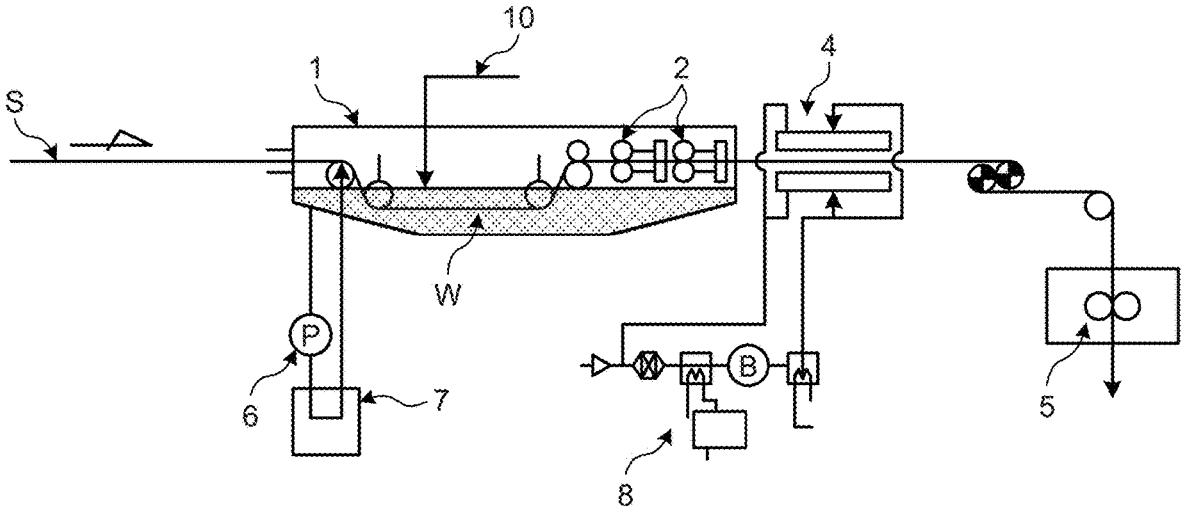
FIG. 4 is a schematic view for explaining a method of cooling and drying an annealed steel sheet on an entrance side of coating equipment.
Figure 5:
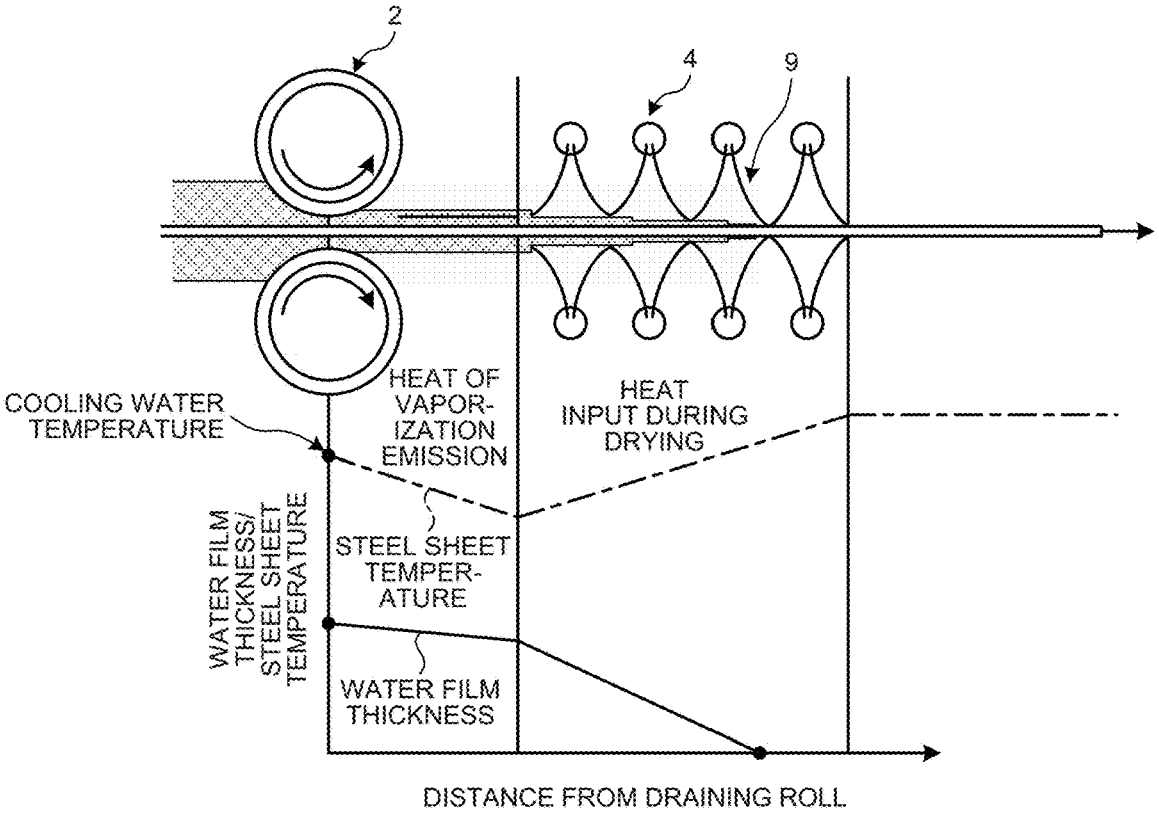
FIG. 5 is a schematic diagram for explaining a relation between a steel sheet temperature and a water film thickness.
Figure 6:
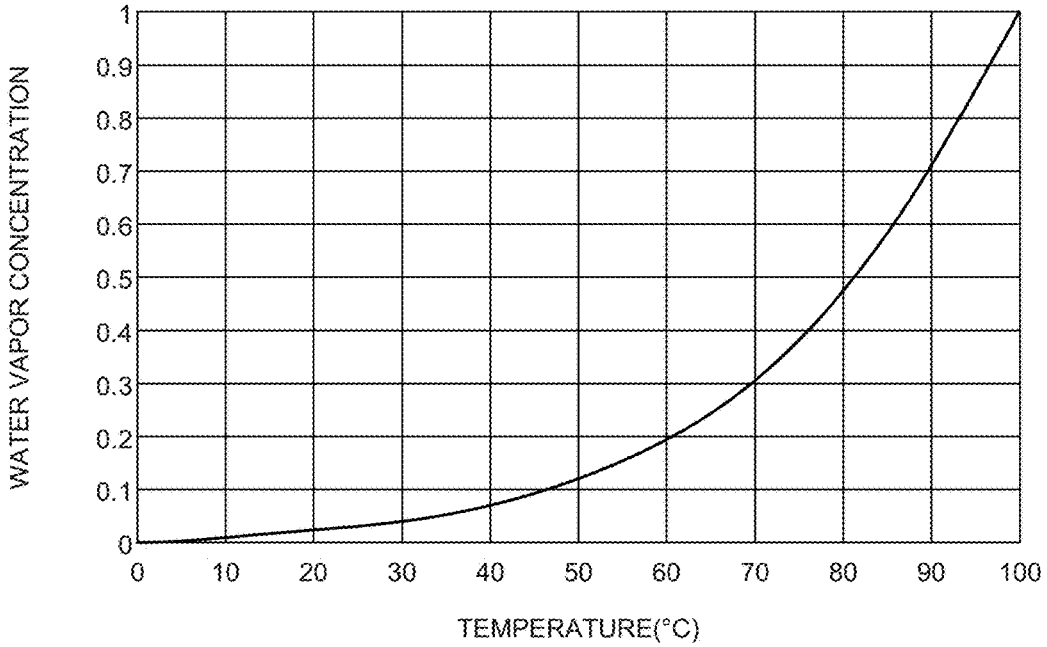
FIG. 6 is a diagram illustrating a relation between water vapor concentration and temperature of a water film.

Subsequently, a cooling water temperature control device for a steel sheet according to the embodiment of the present invention is explained with reference to FIG. 2. FIG. 2 is a schematic diagram illustrating a configuration of the cooling water temperature control device for the steel sheet according to the embodiment of the present invention. As illustrated in FIG. 2, the cooling water temperature control device for the steel sheet according to the embodiment of the present invention has a configuration in which a heat exchanger 21 is provided in a circulation system of the cooling water W in a conventional cooling/drying system illustrated in FIG. 4. When the temperature of the cooling water higher than the set temperature range, the cooling water W is cooled using a chiller 7 and, when the temperature of the cooling water is lower than the set temperature range, the cooling water W is heated using the heat exchanger 21. In an example illustrated in FIG. 2, the cooling water W is sequentially sent, by a circulation pump 6, to the chiller 7 and the heat exchanger 21 that heats the cooling water W using steam G and is supplied to the water cooling tank 1 again. Consequently, the temperature of the cooling water W in the water cooling tank 1 is controlled within the temperature range of the cooling water W calculated by the processing explained above and the annealed steel sheet can be cooled to the predetermined temperature or lower and completely dried.

EXAMPLES

Figure 3:
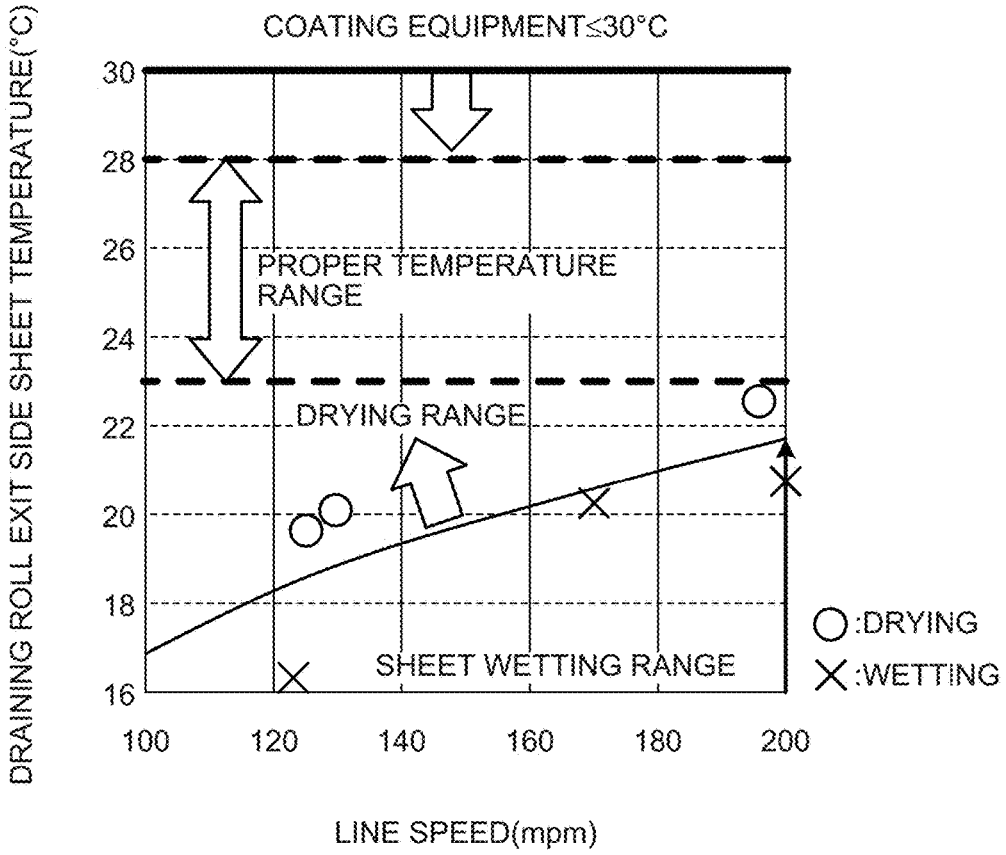
FIG. 3 is a diagram illustrating a result of an experiment performed using the cooling water temperature control device for the steel sheet illustrated in FIG. 2.

FIG. 3 illustrates an experimental result using the cooling water temperature control device for the steel sheet illustrated in FIG. 2. In FIG. 3, the horizontal axis indicates the line speed (mpm). In addition, the vertical axis indicates the steel sheet temperature on the exit side of the draining roll 2 and coincides with the cooling water temperature. Circles in the figure indicate a result in which the water film was successfully completely removed (dried) on the exit side of the drying equipment 4 and crosses indicate a result in which the water film remained (wetted). As illustrated in FIG. 3, it is seen that the cooling water temperature only has to be set to 23° C. or higher in order to dry the water film, for example, at a line speed of 200 mpm. On the other hand, it is seen that in order to set the steel sheet temperature on the entrance side of the coating equipment 5 to 30° C. or lower, since a rise in the steel sheet temperature from the drying equipment 4 to the coating equipment 5 is 2° C., the cooling water temperature only has to be set to 28° C. or lower. From the above, it has been confirmed that, by setting the temperature range of the cooling water within the range of 23 to 28° C., the water film can be completely dried and the steel sheet temperature on the coating equipment entrance side can be set to 30° C. or lower.

The embodiment to which the invention made by the present inventors is applied is explained above. However, the present invention is not limited by the description and drawings forming a part of the disclosure of the present invention according to the present embodiment. That is, all of other embodiments, examples, operation techniques, and the like made by those skilled in the art and the like based on the present embodiment are included in the scope of the present invention.

INDUSTRIAL APPLICABILITY

According to the present invention, it is possible to provide a cooling water temperature control method and a cooling water temperature control device for a steel sheet capable of cooling an annealed steel sheet to a predetermined temperature or lower and completely drying the annealed steel sheet even in a cold period or in the case in which a line is started up again after being stopped for a long period.

REFERENCE SIGNS LIST

1 WATER COOLING TANK
2 DRAINING ROLL

4 DRYING EQUIPMENT
5 COATING EQUIPMENT
6 CIRCULATION PUMP
7 CHILLER
8 DEHUMIDIFIER
9 DEHUMIDIFIED AIR
10 MAKEUP WATER
21 HEAT EXCHANGER
G STEAM
S STEEL SHEET
W COOLING WATER

The invention claimed is:

1. A cooling water temperature control method for a steel sheet for controlling temperature of cooling water in a line including cooling equipment that cools an annealed steel sheet using the cooling water, a draining roll that removes a water film on the steel sheet cooled by the cooling equipment, drying equipment that is disposed on an exit side of the draining roll and dries the steel sheet, and coating equipment that is disposed on an exit side of the drying equipment and coats the steel sheet, the cooling water temperature control method comprising:

(a) calculating thickness of the water film remaining on the steel sheet on the exit side of the draining roll;

(b) calculating a change in the thickness of the water film from the exit side of the draining roll to the exit side of the drying equipment considering line speed;

(c) calculating a change in temperature of the steel sheet from the exit side of the draining roll to an entrance side of the coating equipment considering the line speed;

(d) calculating, using calculation results of (a) to (c), a steel sheet temperature on the exit side of the draining roll at which a position where the thickness of the water film on the steel sheet becomes zero coincides with an exit side position of the drying equipment, and setting the calculated steel sheet temperature to a lower limit value of cooling water temperature;

(e) calculating, using the calculation results of (a) to (c), a steel sheet temperature on the exit side of the draining roll at which the steel sheet temperature on the entrance side of the coating equipment coincides with a predetermined temperature and setting the calculated steel sheet temperature to an upper limit value of the cooling water temperature; and (f) controlling the temperature of the cooling water within a range of the lower limit value and the upper limit value set in (d) and (e).

2. A cooling water temperature control device for a steel sheet that controls temperature of cooling water in a line including cooling equipment that cools an annealed steel sheet using the cooling water, a draining roll that removes a water film on the steel sheet cooled by the cooling equipment, drying equipment that is disposed on an exit side of the draining roll and dries the steel sheet, and coating equipment that is disposed on an exit side of the drying equipment and coats the steel sheet, the cooling water temperature control device comprising a processor comprising hardware, the processor being configured to:

(a) calculate thickness of the water film remaining on the steel sheet on the exit side of the draining roll;

(b) calculate a change in the thickness of the water film from the exit side of the draining roll to the exit side of the drying equipment considering line speed;

(c) calculate a change in temperature of the steel sheet from the exit side of the draining roll to an entrance side of the coating equipment considering the line speed;

(d) calculate, using calculation results of (a) to (c), a steel sheet temperature on the exit side of the draining roll at which a position where the thickness of the water film on the steel sheet becomes zero coincides with an exit side position of the drying equipment, and set the calculated steel sheet temperature to a lower limit value of cooling water temperature;

(e) calculate, using the calculation results of (a) to (c), a steel sheet temperature on the exit side of the draining roll at which the steel sheet temperature on the entrance side of the coating equipment coincides with a predetermined temperature and set the calculated steel sheet temperature to an upper limit value of the cooling water temperature; and (f) control the temperature of the cooling water within a range of the lower limit value and the upper limit value set in (d) and (e).

* * * * *